US005142107A

United States Patent [19]

Nagatai Yasuhiro

[11] Patent Number: 5,142,107

[45] Date of Patent: Aug. 25, 1992

[54] APPARATUS FOR CONTROLLING GROUP SUPERVISORY OPERATION OF ELEVATORS USING A CONTROL COMPUTER AND A LEARNING COMPUTER

[75] Inventor: Nagatai Yasuhiro, Inazawa, Japan

[73] Assignee: Mitsubishi Denki Kabushiki Kaisha, Japan

[21] Appl. No.: 713,088

[22] Filed: Jun. 11, 1991

[30] Foreign Application Priority Data

Jun. 15, 1990 [JP] Japan ..... 2-155352

[51] Int. Cl.[5] ..... B66B 1/18

[52] U.S. Cl. ..... 187/127

[58] Field of Search ..... 187/102, 127; 364/900

[56] References Cited

U.S. PATENT DOCUMENTS 4,473,135 9/1985 Yonemoto ..... 187/102

4,542,479 9/1985 Kamimura et al. ..... 364/900

*Primary Examiner*—A. D. Pellinen

*Assistant Examiner*—Lawrence E. Colbert

*Attorney, Agent, or Firm*—Leydig, Voit & Mayer

[57] ABSTRACT

An apparatus for controlling group supervisory operation of elevators comprises a first computer for performing hall call control and car assignment control at usual times, a second computer for performing learning control at usual times, a system bus which connects the first computer to the second computer, and an abnormality detection device for disconnecting a computer which has developed a fault from the system bus if an abnormality of either the first computer or the second computer is detected and for making the computer which is operating normally perform the functions of the two computers.

6 Claims, 4 Drawing Sheets

APPARATUS FOR CONTROLLING GROUP SUPERVISORY OPERATION OF ELEVATORS USING A CONTROL COMPUTER AND A LEARNING COMPUTER

BACKGROUND OF THE INVENTION

1. Field of the Invention The present invention relates to an apparatus for controlling group supervisory operation of elevators which is capable of centrally controlling a plurality of elevator cars in order to make them run efficiently and, in particular, to a highly reliable apparatus for controlling group supervisory operation of elevators which is capable of preventing a considerable decrease in group control functions when an elevator develops a fault.

2. Description of the Related Art

FIG. 4 is a block diagram showing the construction of a conventional apparatus for controlling group supervisory operation of elevators which is, for example, disclosed in Japanese Patent Laid-Open No. 59-124667. In FIG. 4, reference numeral 1 denotes a first computer which has a CPU 1*a*, a ROM 1*b*, and a RAM 1*c*. Likewise, reference numeral 2 denotes a second computer which has a CPU 2*a*, a ROM 2*b*, and a RAM 2*c*. Reference numeral 3 denotes a fault detection logic circuit, connected between these first and second computers 1 and 2, for monitoring the operating status thereof. Reference numerals 4*a* and 4*b* each denote a peripheral interface adapter (PIA) employed as a programmable general-purpose input/output interface element. These adapters 4*a* and 4*b* are respectively connected to the first computer 1 and the second computer 2 and controlled by the CPUs 1*a* and 2*a*, respectively. Reference numerals 5*a*, 5*b*. . . 5*h* each denote a car control apparatus for controlling the running status of each of a plurality of elevator cars (not shown). Reference numeral 6*a* denotes an input/output bus connected to a PIA 4*a* or 4*b* via a switch 7*a* and connected to a hall call registration button HB. Reference numeral 6*b* denotes an input-/output bus connected to a PIA 4*a* or 4*b* via a switch 7*b* and connected to a hall call registration lamp HL. Reference numeral 6*c* denotes an input/output bus connected to a PIA 4*a* or 4*b* via a switch 7*c* and connected to each of the car control apparatus 5*a*, 5*b*. . . 5*h*. Reference numeral 6*d* denotes an input/output bus connected to a PIA 4*a* or 4*b* via a switch 7*d* and connected to each of the car control apparatuses 5*a*, 5*b*. . . 5*h*. These input-/output buses 6*a* to 6*d* are controlled by the PIAs 4*a* and 4*b*. Switches 7*a* to 7*d* form an input/output bus automatic switching apparatus 7 which operates in response to the detection output from the fault detection logic circuit 3.

The switches 7*a* to 7*d* are kept in a state shown in FIG. 4 when no fault of either the first computer 1 or the second computer 2 is detected by the fault detection logic circuit 3. That is, input/output buses 6*a*, 6*b*, and 6*c* are each connected to the PIA 4*a* and placed under the control of the first computer 1 and the input/output bus 6*d* is connected to the PIA 4*b* and placed under the control of the second computer 2. However, if the second computer 2 should develop a fault in a state in which the first computer 1 is operating normally, because the switch 7*d* is switched by the detection output from the fault detection logic circuit 3, the input/output bus 6*d* for communicating with car control apparatuses 5*a*, 5*b*. . . 5*h* is connected to the CPU 1*a* via the PIA 4*a*, placed under the control of the first computer 1, and disconnected from the faulty second computer 2. In contrast, if the first computer 1 should develop a fault in a state in which the second computer 2 is operating normally, because the switches 7*a*, 7*b*, and 7*c* are switched by the detection output from the fault detection logic circuit 3, the input/output buses 6*a* to 6*d* are connected to the second computer 2, placed under the control of the second computer 2 and disconnected from the faulty first computer 1.

In such a conventional apparatus for controlling group supervisory operation of elevators as described above, the construction of hardware for switching the input/output of the input/output buses is extremely complex, and the reliability of the input/output path through which signals are input and output decreases. Also, as the group control functions have improved in recent years, the amount of control information handled by the first and second computers 1 and 2 has increased and the amount of data transmitted between the two CPUs 1*a* and 2*a* has also increased. Therefore, such an arrangement of separate buses is problematical in that it is not possible to transmit a large amounts of data with high efficiency.

SUMMARY OF THE INVENTION

The present invention has been devised to solve the above-mentioned problems. Accordingly, an object of the present invention is to obtain a highly reliable apparatus for controlling group supervisory operation of elevators, in which a duplex system using two computers is realized and the transmission of large amounts of data between the two CPUs is performed efficiently, thus improving the group control function, and in which, if one of the computers should develop a fault, a considerable decrease in the group control functions will not occur.

To this end, according to the present invention, there is provided an apparatus for controlling group supervisory operation of elevators comprising: a first computer for performing hall call control and car assignment control at usual times; a second computer for performing learning control at usual times; a system bus which connects the first computer to the second computer; and an abnormality detection means for disconnecting a computer which has developed a fault from the system bus if an abnormality of either the first computer or the second computer is detected and for making the computer which is operating normally perform the functions of the two computers.

DESCRIPTION OF THE PREFERRED EMBODIMENT

An embodiment of the present invention will be explained hereinbelow with reference to the accompanying drawings.

Figure 1:
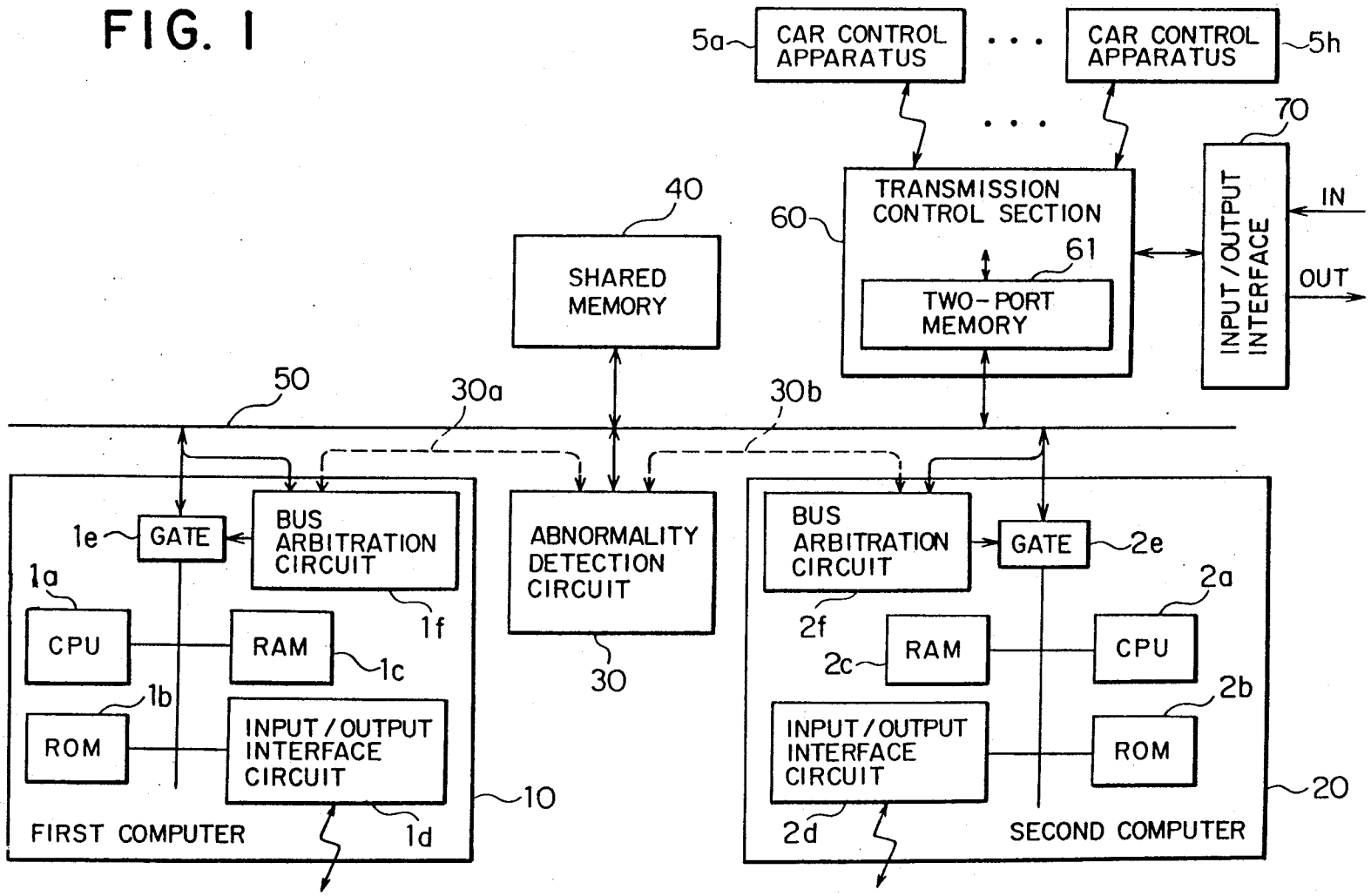
FIG. 1 is a block diagram showing an apparatus for controlling group supervisory operation of elevators of an embodiment of the present invention.

In FIG. 1, a first computer 10 and a second computer 20 are connected to a system bus 50, the various functions being divided individually therebetween. These first and second computers 10 and 20 have CPUs 1*a* and 2*a*, ROMs 1*b* and 2*b*, RAMs 1*c* and 2*c*, input/output interface circuits 1*d* and 2*d* which interface with various kinds of external devices (not shown), gates 1*e* and 2*e* which connect the system bus 50 to each of the respective buses in the computers, and bus arbitration circuits 1*f* and 2*f* for controlling the exclusive use of the system bus 50 when each respective computer uses the system bus 50. The opening/closing of the gates 1*e* and 2*e* is controlled by the bus arbitration circuits 1*f* and 2*f*, respectively. Reference numeral 30 denotes an abnormality detection circuit, connected to the first computer 10 and the second computer 20 through the system bus 50, for monitoring the operating status of the computers. Reference numeral 40 denotes a memory which is shared by the first computer 10 and the second computer 20 through the system bus 50. Reference numeral 60 denotes a transmission control section for controlling the transmission among car control apparatuses 5*a*. . . 5*h*. The transmission control section 60 has a two-port memory 61 by which data is transmitted between the first computer 10 and the second computer 20, as well as a CPU, a ROM, a RAM and an I/F circuit for car control apparatuses. Reference numeral 70 denotes an input/output interface for a hall apparatus (not shown) and others.

Next, a description will be provided of the operation of an apparatus for controlling group supervisory operation of elevators constructed as described above. Usually, the first computer 10 mainly performs hall call control and car assignment control and the second computer 20 mainly performs running status learning control, traffic forecasting, etc. The first computer 10 sends and receives data required for group control, such as operation control information, to and from the second computer 20, or vice versa, through a shared memory 40. The exclusive use of the system bus 50 is efficiently switched by the bus arbitration circuits 1*f* and 2*f* respectively disposed in the respective computers. Data from car control apparatuses 5*a* to 5*h*, input/output data from floors, etc., is processed by the transmission control section 60 and sent and received to and from the first computer 10 through the two-port memory 61 and the system bus 50.

Operations in a case where the first computer 10 fails will now be explained. When the abnormality detection circuit 30 detects that the first computer 10 has failed, an abnormality detection signal 30*a* is input to the bus arbitration circuit 1*f*. Thereupon, the bus arbitration circuit 1*f* outputs a signal to the gate 1*e* so that the gate 1*e* is shut off and the first computer 10 is disconnected from the system bus 50. From this time on, the normally operating second computer 20 performs the functions of the first computer 10. In contrast to this, if the second computer 20 is detected to be functioning abnormally, an abnormality detection signal 30*b* is input to the bus arbitration circuit 2*f* and the gate 2*e* is shut off. As a result, the second computer 20 is disconnected from the system bus 50. From this time on, the normally operating first computer 10 performs the functions of the second computer 20.

Figure 2:
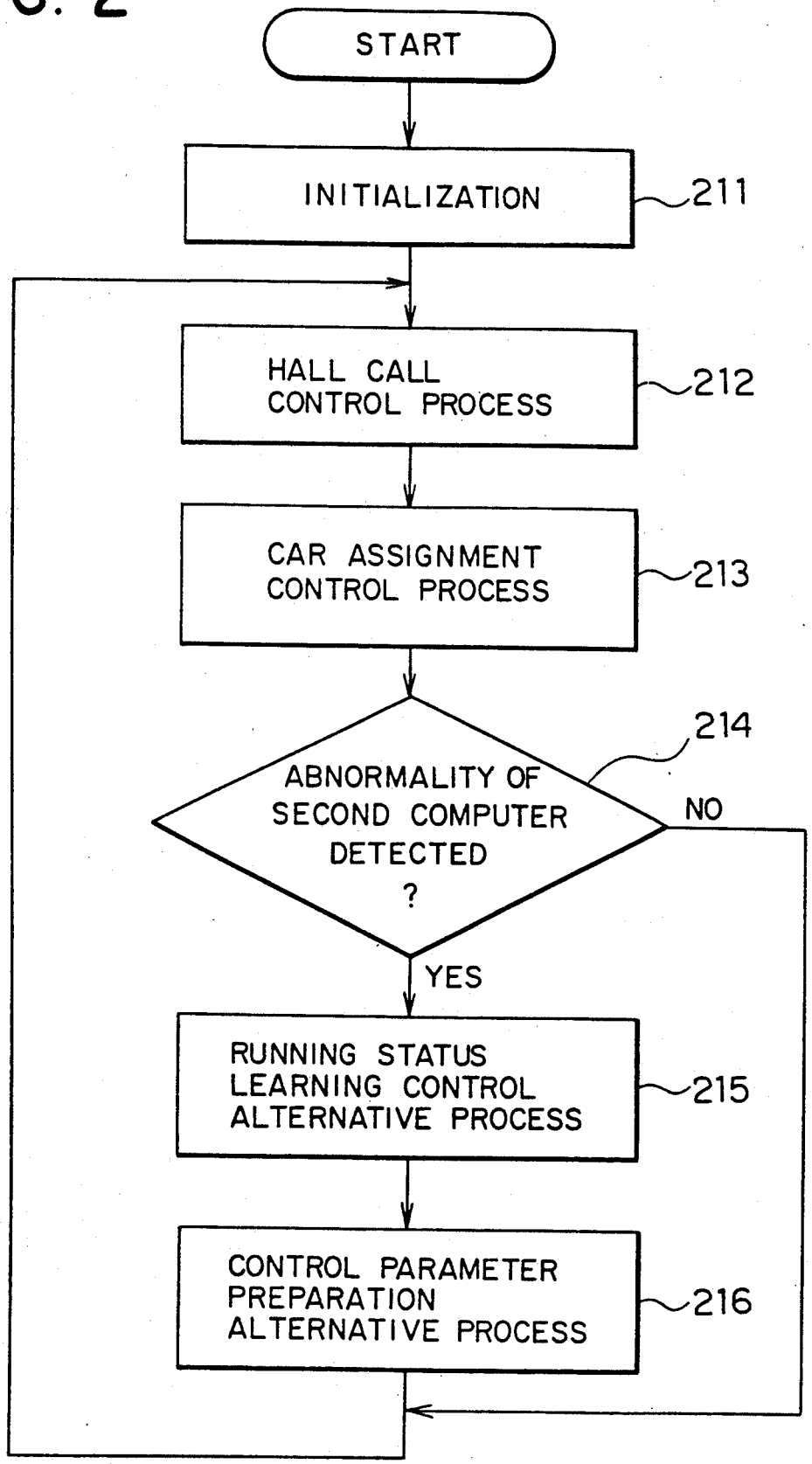
FIG. 2 is a flowchart showing the operation of a first computer of the embodiment of the present invention.
Figure 3:
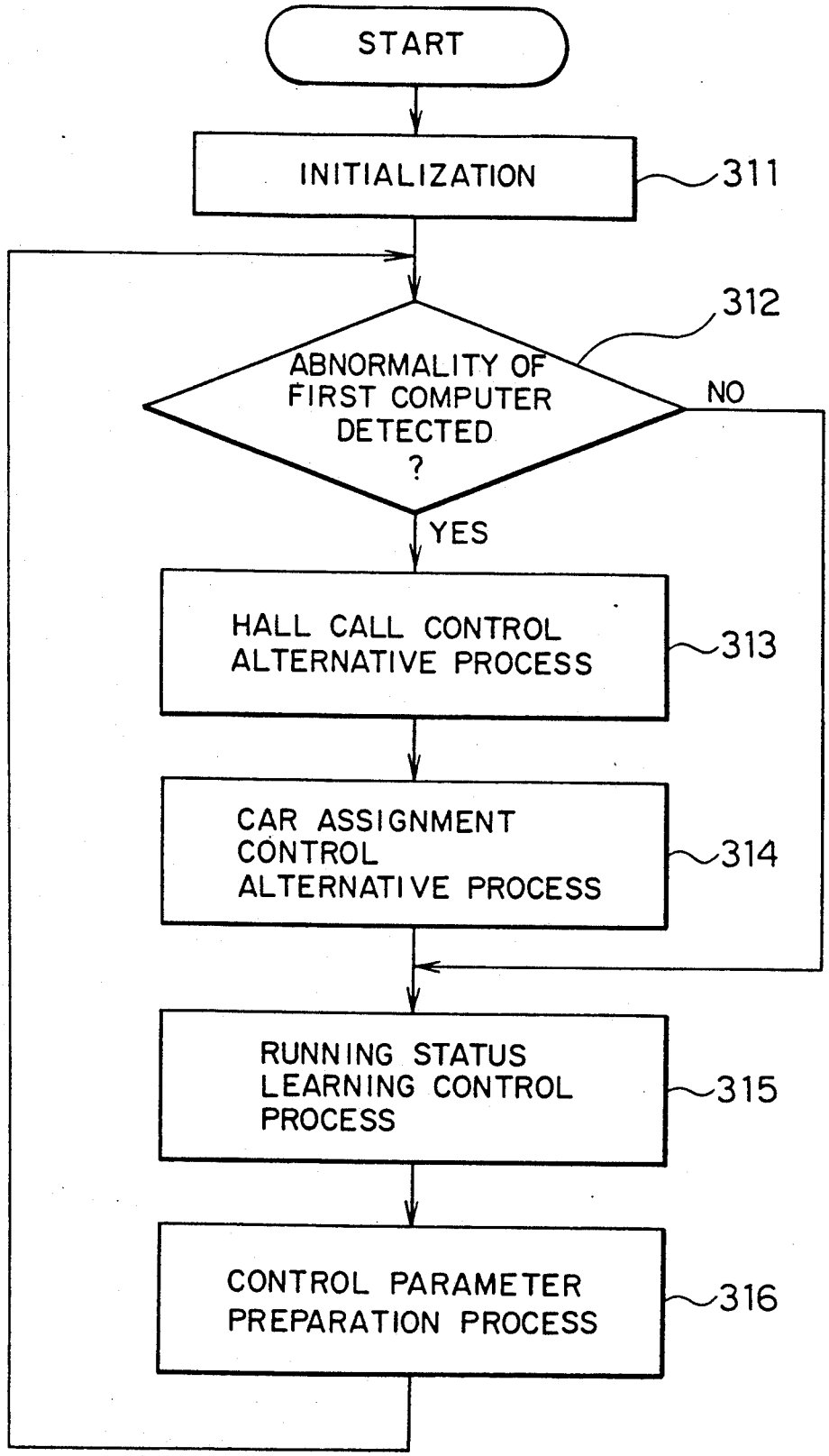
FIG. 3 is a flowchart showing the operation of a second computer of the embodiment of the present invention.
Figure 4:
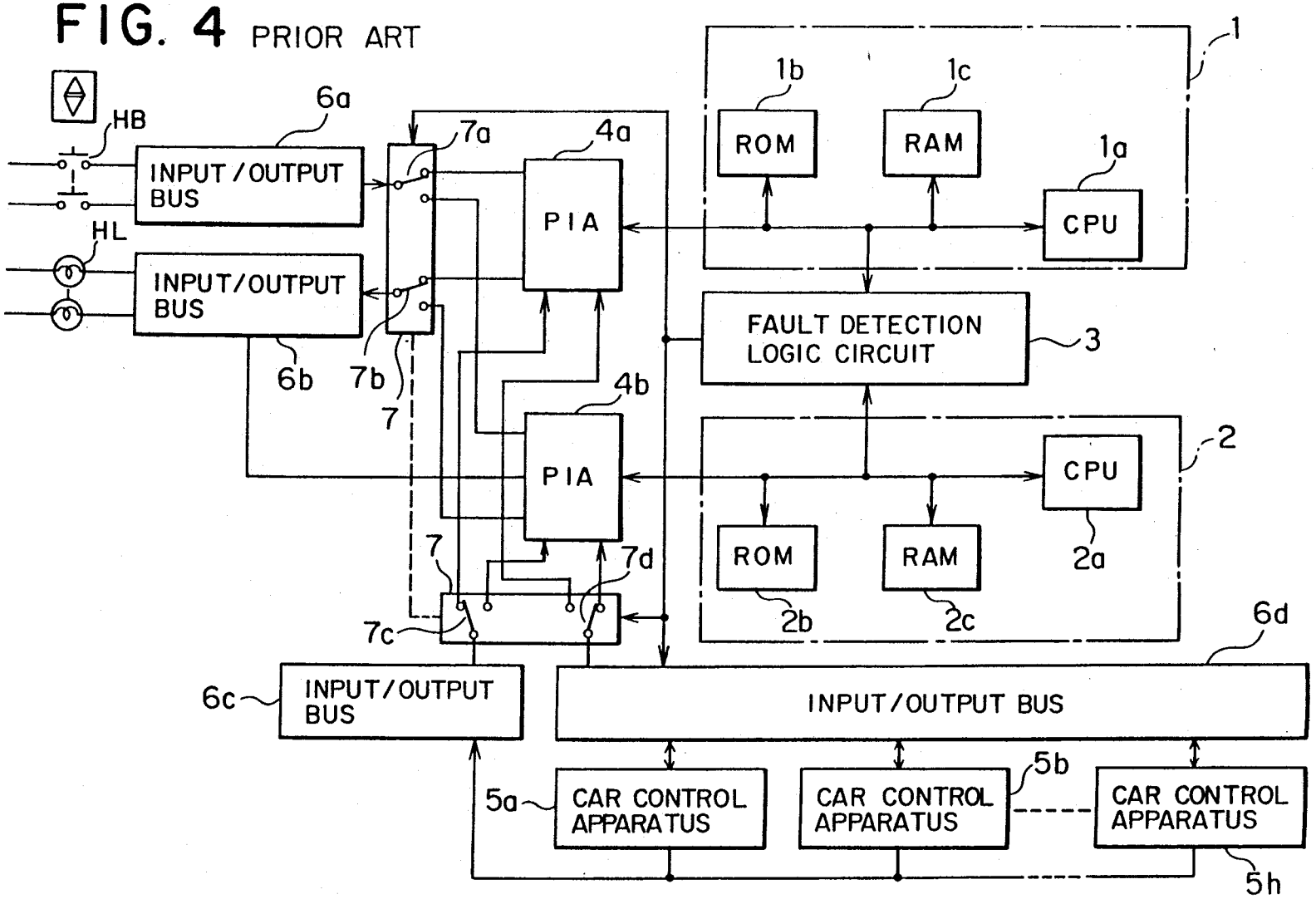
FIG. 4 PRIOR ART
FIG. 4 is a block diagram showing a conventional apparatus for controlling group supervisory operation of elevators.

FIGS. 2 and 3 are flowcharts showing the sequence of the operations of the whole elevator executed by the CPU 1*a* of the first computer 10 and the CPU 2*a* of the second computer 20, respectively.

In FIG. 2, when programs of the first computer 10 begin to be executed, first, initialization for respective sections is performed in step 211. A hall call control process is performed in step 212 and a car assignment control process is performed in step 213 in accordance with hall call information or car information obtained via the two-port memory 61 in the transmission control section 60 and control parameters prepared in the second computer 20. It is determined in step 214 whether or not an abnormality of the second computer 20 has been detected by the abnormality detection circuit 30. If it is determined that the second computer 20 is normally functioning without an abnormality being detected, the process returns to step 212 and operations are repeated in a similar manner as described above. If it is determined that the second computer 20 is functioning abnormally, alternative processes for running status learning control and control parameter preparation which should have been performed by the second computer 20 are performed in steps 215 and 216, respectively. Thereafter, the process returns to step 212 and operations are repeated in a similar manner as described above.

Next, in FIG. 3, when programs of the second computer 20 begin to be executed, initialization for respective sections is performed in step 311. It is determined in step 312 whether or not an abnormality of the first computer 10 has been detected by the abnormality detection circuit 30. If it is determined that the first computer 10 is functioning normally, a running status learning control process is performed in step 315 such that characteristics of the traffic peculiar to the building are learned from the past operations of the elevators and traffic in the near future is forecast. Based on the results of the above process, the process of preparing control parameters used for assigning cars by the first computer 10 is performed in step 316. Thereafter, the process returns to step 312, and operations are repeated in a similar manner as described above. If it is detected in step 312 that the first computer 10 has begun functioning abnormally, substitute processes of hall call control and car assignment control which should have been performed by the first computer 10 are performed in steps 313 and 314, respectively. Thereafter, the process returns to step 315 where the process mentioned earlier is performed, and operations are repeated in a similar manner as described above.

Further, in a case where both the first computer 10 and the second computer 20 have failed, this state is detected by the transmission control section 60. Based on this detection, backup running, such as a stop at each of the service floors, and skip running, is performed. Thus, a minimum of functions are maintained.

In the above-mentioned embodiment, the abnormality detection circuit 30 which is commonly used for both the first computer 10 and the second computer 20 is disposed as an abnormality detection means therefor. This abnormality detection circuit may be disposed in each of the computers. The same advantages can be obtained by an arrangement in which an abnormality detection means is formed by software by means of which normal transmission of data is confirmed by the first computer 10 and the second computer 20 by using a shared memory 40 without the abnormality detection circuit 30.

What is claimed is:

1. An apparatus for controlling group supervisory operation of elevators comprising:

a first computer for performing hall call control and car assignment control at usual times;

a second computer for performing learning control at usual times;

a system bus which connects said first computer to said second computer; and abnormality detection means for disconnecting a computer which has developed a fault from said system bus if an abnormality of either said first computer or said second computer is detected and for making the computer which is operating normally perform the functions of the two computers.

2. A control apparatus according to claim 1 further comprising a memory commonly used for said first and second computers and connected to said system bus.

3. A control apparatus according to claim 1 wherein said abnormality detection means comprises an abnormality detection circuit common to said first and second computers.

4. A control apparatus according to claim 1 wherein said abnormality detection means comprises a first and a second means disposed respectively in said first and second computers.

5. A control apparatus according to claim 1 further comprising:

a plurality of car control apparatuses respectively corresponding to a plurality of elevator cars and controlling the running of each respective car; and transmission control means connected to said plurality of car control apparatuses and controlling the transmission with said system bus.

6. An apparatus for controlling group supervisory operation of elevators comprising:

a first computer for performing hall call and car assignment operations;

a second computer for performing learning control operations;

a system bus which interconnects said first and second computers;

an abnormality detection circuit connected to said system bus for generating an abnormality signal when an abnormality is detected in one of said first and second computers; and first and second bus arbitration circuits corresponding to said first and second computers, respectively, for disconnecting a computer from said system bus responsive to the abnormality signal generated by said abnormality detection circuit, where the computer that remains connected to said system bus performs the operation of said first and second computer.

* * * * *

UNITED STATES PATENT AND TRADEMARK OFFICE

CERTIFICATE OF CORRECTION

PATENT NO. : 5,142,107

DATED : August 25, 1992

INVENTOR(S) : Nagata Yasuhiro

It is certified that error appears in the above-identified patent and that said Letters Patent is hereby corrected as shown below:

On the title page, Item [19] and [75]:
Inventors, change "Nagatai" to --Nagata--.

Item no. 56, References Cited, U.S. Patent Documents, change "9/1985" to --9/1984--.

Signed and Sealed this

Twenty-first Day of September, 1993

Bruce Lehman

*Attest:*

BRUCE LEHMAN

*Attesting Officer*

*Commissioner of Patents and Trademarks*